United States Patent [19]

Fabian et al.

[11] Patent Number: 4,473,385

[45] Date of Patent: Sep. 25, 1984

[54] LOWER PRESSURE FRACTIONATION OF WASTE GAS FROM AMMONIA SYNTHESIS

[75] Inventors: Rainer Fabian, Geretsried; Wolfgang Schmid, Grünwald; Herwig Landes, Ingolstadt, all of Fed. Rep. of Germany

[73] Assignee: Linde Aktiengesellschaft, Wiesbaden, Fed. Rep. of Germany

[21] Appl. No.: 449,794

[22] Filed: Dec. 14, 1982

[30] Foreign Application Priority Data

Dec. 16, 1981 [DE] Fed. Rep. of Germany ..... 3149846

[51] Int. Cl.[3] ..... F25J 3/04

[52] U.S. Cl. ..... 62/30; 62/31; 62/34; 62/39; 62/41; 62/42

[58] Field of Search ..... 62/24, 29, 30, 31–34, 62/38, 39, 42; 423/655, 656, 359; 48/197

[56] References Cited

U.S. PATENT DOCUMENTS 3,327,487 6/1967 Karwat ..... 62/38

*Primary Examiner*—Frank Sever

*Attorney, Agent, or Firm*—Millen & White

[57] ABSTRACT

In a low temperature process for the fractionation of ammonia synthesis waste gas ($N_2$, $H_2$, Ar, $CH_4$) comprising two successive separating stages and a nitrogen refrigeration cycle for supplying reboiler heat to each of the stages and also liquid nitrogen, wherein nitrogen is compressed in a compressor to a final pressure, cooled, expanded, and partially liquefied, gaseous and revaporized liquid nitrogen being recompressed, the improvement comprising compressing the nitrogen to a medium pressure, e.g., 6-20 bar, withdrawing a portion of resultant medium-pressure nitrogen from the compressor, compressing remaining medium-pressure nitrogen to the final pressure, e.g., 30-50 bar, cooling resultant medium-pressure nitrogen in parallel with resultant final-pressure nitrogen, further cooling the medium-pressure nitrogen by supplying reboiler heat to the two separating columns, expanding resultant cooled medium-pressure nitrogen to at least partially liquefy the same, expanding resultant cooled final-pressure nitrogen to at least partially liquefy the same, and combining both resultant at least partially liquefied nitrogen streams in a phase separator.

20 Claims, 2 Drawing Figures

LOWER PRESSURE FRACTIONATION OF WASTE GAS FROM AMMONIA SYNTHESIS

BACKGROUND OF THE INVENTION

This invention relates to a process and apparatus for the low temperature fractionation of a gas, e.g., an ammonia synthesis waste gas into hydrogen, nitrogen, argon and methane, especially to a system comprising two successive fractionating stages wherein a nitrogen refrigeration cycle is employed for supplying reboiler heat for each of the stages and liquid nitrogen as well.

In the production of ammonia synthesis gas by steam reforming, there is obtained a waste gas rich in argon and methane, besides being rich in hydrogen and nitrogen. According to a conventional method [Winnacker-Küchler, Chem. Technologie 2:494 (1969)], this waste gas is fractionated in a low-temperature process wherein, on the one hand, the hydrogen is recovered, and on the other hand, pure argon is produced. Fractionation is conducted in two successive separating stages. A nitrogen refrigeration cycle is provided for producing the low temperatures required for the separation of the components. Nitrogen from the head of the second separating stage as well as from a storage tank is compressed to 150–200 bar and then cooled. A partial stream of the cooled compressed nitrogen is engine-expanded and utilized for heating the sump of the second separating stage. Another partial stream of the cooled compressed nitrogen is further cooled by heat exchange with the uncompressed nitrogen and utilized to heat the sump of the first separating stage. The two partial streams are subsequently expanded, in partially liquefied form, into a storage tank. Liquid nitrogen is withdrawn from the storage tank as scrubbing liquid for the second separating stage and for cooling the head of the first separating stage. A portion of the nitrogen which has remained in the gaseous phase, together with nitrogen from the head of the second separating stage, is heated in heat exchange with synthesis waste gas feed, while another portion of the nitrogen which has remained in the gaseous phase is heated in heat exchange with nitrogen for the heating of the first separating stage and is recompressed. A portion of the liquefied nitrogen, after revaporization, is recompressed together with a portion of the gaseous nitrogen. Excess nitrogen is withdrawn from the plant after heat exchange with the synthesis waste gas feed.

Although this process is advantageous insofar as it permits the recovery of hydrogen and argon, it is very expensive with respect to the equipment required owing to the high pressures required in the nitrogen refrigeration cycle. Pressures on the order of 150 to 200 bar involve the use of high pressure compressors and heat exchangers which are expensive, trouble-prone, and difficult to service.

SUMMARY

An object of the present invention is to provide a process of the type discussed above wherein the high pressure refrigeration cycle can be replaced by a refrigeration cycle operating at a significantly lower pressure, thereby permitting the utilization of less expensive, more easily maintainable equipment.

Another object is to provide apparatus to conduct the process of this invention.

Upon further study of the specification and appended claims, further objects and advantages of this invention will become apparent to those skilled in the art.

To attain these objects, the nitrogen is compressed in a multi-stage compressor, and a portion of the nitrogen is withdrawn at an intermediate medium pressure below the final stage pressure and cooled in parallel with the final pressure nitrogen, further cooled by heating the two separating stages, partially liquefied, and combined with the final-pressure nitrogen after expansion of the latter.

In the process of this invention, both nitrogen streams —the stream at medium pressure as well as the stream at final pressure —are cooled together and utilized for heating the sumps of the first and second separating stages. Subsequently, the two nitrogen streams are expanded and combined together in partially liquefied condition, wherein the liquid nitrogen, as in the prior art method, is introduced, in part, as scrubbing liquid into the second separating stage and, in part, used for cooling the head of the first separating stage. Whereas heretofore, the nitrogen was compressed to a very high pressure and a portion of the nitrogen under high pressure was utilized for heating the sump of the first separating stage, while the residual nitrogen was engine-expanded and employed for heating the sump of the second separating stage, the present invention now provides that a nitrogen stream compressed to a far lower pressure (the final pressure) is utilized for the sump heating of both separating stages and simultaneously a further nitrogen stream at a still lower pressure level (the medium pressure) is used, in parallel with the first nitrogen stream, for the sump heating of both separating stages.

By the present invention, the final pressure of the nitrogen can be markedly lowered while maintaining the refrigerating capacity required for the process. In particular, the compressor in the nitrogen cycle is selected so that the final pressure thereof is less than 75 bar.

Preferably the range of the final pressure is between 25 and 50 bar, particularly between 30 and 45 bar, and especially about 40.5 bar. These final pressures present minimal problems compared to the 150–200 bar pressures of the prior art. Generally the medium pressure is in the range of 15 to 35% of the final pressure. According to a preferred embodiment of the process of this invention, the medium pressure is between 6 and 20 bar, particularly between 10 and 16 bar, especially about 13.5 bar.

Whereas adequate refrigerating capacity for the process is obtained within the indicated pressure ranges for the medium and final pressures, the specific pressures to be used will depend on external process conditions, such as gas composition and gas pressure. However, by virtue of the present invention, the pressures employed in the process of this invention are within a pressure range lying markedly below the high pressures heretofore required for the refrigeration cycle. Consequently, it is now possible to utilize plate-type heat exchangers, which can be manufactured substantially more economically, instead of the heretofore necessary wound heat exchangers. Even if the nitrogen at final pressure is still above the critical point and therefore is not liquefied during cooling in the first separating stage, this nitrogen will be cooled without rapid phase change along the steep ranqe of the enthalpy curve during the heating of the first separating stage. In this range, relatively small amounts of nitrogen are adequate for the required heating power.

It is advantageous according to a further development of the process of this invention to engine-expand a portion e.g., 60 to 90%, of the compressed, cooled nitrogen and to combine same with the gaseous proportion of the partially liquefied nitrogen.

To produce refrigeration, either nitrogen at medium pressure or nitrogen at final pressure is engine-expanded. If a portion, e.g., 70 to 90%, of the medium-pressure nitrogen is engine-expanded, then the outlet pressure is advantageously chosen to be equal to the pressure of the revaporized nitrogen. If final-pressure nitrogen is engine-expanded, then a higher outlet pressure is suitably set so that an optimum pressure gradient is attained at the expansion engine.

According to a preferred embodiment of the present invention, the engine-expanded nitrogen is expanded to a pressure above the inlet pressure of the compressor and is fed to the compressor at an intermediate point. In this connection, the pressure at the intermediate point is advantageously below the medium pressure of the partial nitrogen stream withdraw from the compressor.

In a further development of the present invention, liquefied nitrogen is withdrawn from the phase separator. A portion of said liquefied nitrogen is vaporized, partly by cooling the head of the first separating stage. For example, 20 to 30% of the withdrawn liquefied nitrogen are vaporized by cooling the first separating stage. The vaporized nitrogen is admixed to a gaseous nitrogen stream withdrawn from the head of the second separating stage. The combined streams are heated in heat exchange with waste synthesis gas, and subsequently conducted to the inlet of the compressor.

In a further development of the present invention, the quantity of the combined vaporized and gaseous nitrogen streams is essentially the same as the quantity of the nitrogen and argon components which are contained in the waste synthesis gas to be cooled in heat exchange with said combined streams. As a result there will be a lack of low pressure nitrogen to be heated in heat exchange with nitrogen of medium pressure and nitrogen of final pressure to be cooled. This makes it possible to evaporate a maximum quantity of refrigerant in heat exchange with medium and final pressure nitrogen, thereby reducing the quantity of nitrogen to be engine-expanded and saving energy at the compressor.

In a preferred embodiment of the invention, the medium-pressure nitrogen, utilized for heating the first separating stage, yields between 5% and 20%, especially about 10%, of the required total heat in the first separating stage.

In another preferred embodiment of the invention, the medium-pressure nitrogen, utilized for heating the second separating stage, yields between 60% and 90%, especially about 75%, of the required total heat in the second separating stage.

In both separating stages, the residual heating requirements are provided by the final-pressure nitrogen.

An apparatus for conducting the process of this invention comprises two series-connected separating columns, as well as a nitrogen refrigeration cycle containing a compressor, a heat exchanger, reboilers in the sump of the two separating columns, and a nitrogen storage tank, wherein the outlet of the compressor is in communication with the heat exchanger, and the cold end of the latter is in communication with the two reboilers, and wherein the reboilers terminate on the outlet side into the storage tank, this apparatus being characterized in that the compressor comprises at least two stages, the outlets of the two compressor stages being conducted separately from each other through the heat exchanger and the two reboilers and terminating together into the storage tank; and that the flow path for the nitrogen from the first or second compressor stage is connected to an expansion engine.

In an advantageous embodiment of the apparatus of this invention, the expansion engine is connected on the outlet side via a heat exchanger with a return line for gaseous nitrogen leading to the compressor.

In another advantageous embodiment of the apparatus of this invention, condensing means in the head of the first separating column is connected on the inlet side with the nitrogen storage tank and on the outlet side with another return line for gaseous nitrogen leading to the compressor.

BRIEF DESCRIPTION OF DRAWINGS

The invention, as well as further details of the invention, will be explained in greater detail with reference to schematically illustrated drawings, wherein.

DETAILED DESCRIPTION

Figure 1:
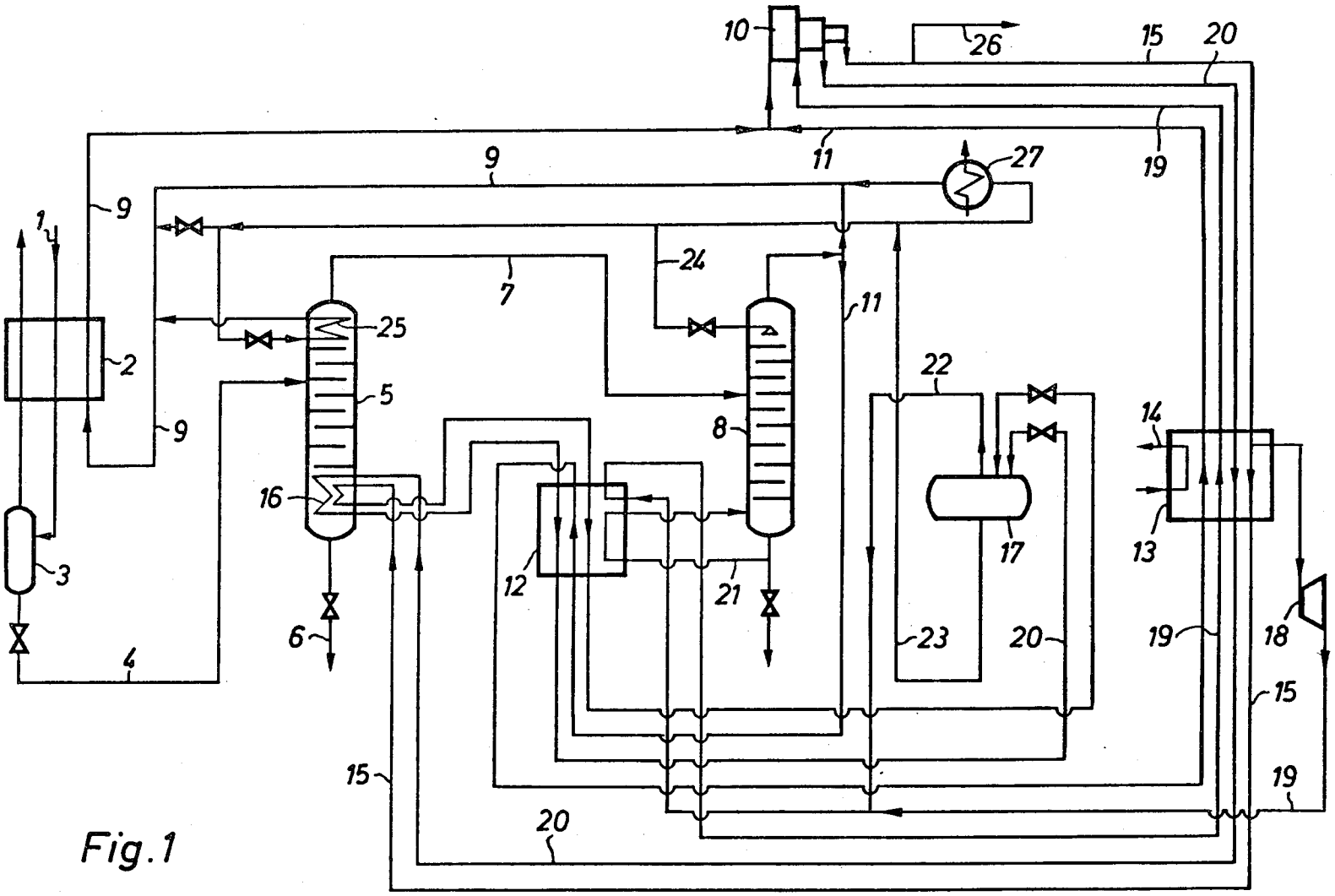
FIG. 1 is a preferred comprehensive embodiment of the invention, wherein engine-expanded gas is returned to the inlet of the second stage of a three-stage compressor.

A synthesis waste gas (purge gas) from an ammonia synthesis gas plant based on steam reforming has, for example, a composition of 31 mol.-% $H_2$, 10 mol.-% $N_2$, 19 mol.-% Ar, and 40 mol.-% $CH_4$. This gaseous mixture is to be separated into its components.

The synthesis waste gas, fed at 1, has been freed of water and ammonia in a conventional process stage (not illustrated). In a heat exchanger 2, the synthesis waste gas is cooled to about 85 K. in heat exchange with hydrogen product from the separation and with a nitrogen refrigeration cycle and is partially liquefied during this step. The gaseous proportion, containing hydrogen at product purity (about 94.7 mol.-%), is withdrawn overhead from a subsequent separator 3 and discharged after being heated in heat exchanger 2. The liquid fraction, containing almost the entire argon and methane, as well as a large portion of the nitrogen, is introduced via a conduit 4 into a first separating column 5 (methane column), from which a methanefree nitrogen-argon fraction is withdrawn as overhead, and liquid methane is discharged as bottoms. The first separating column 5 is operated at a pressure of about 2.2 bar. The methane (about 97 mol.-%) is withdrawn via conduit 6 at a temperature of about 122 K.

The nitrogen-argon fraction is introduced at about 89 K. via conduit 7 into a separating column 8 (argon column) operated under a pressure of about 2 bar. In this column, fractionation takes place into nitrogen as overhead and argon product as bottoms. The liquid argon leaves the second separating column 8 at about 94 K., the nitrogen at about 83.5 K. The argon has a product purity of almost 100%, the nitrogen purity is about 94%.

To conduct the rectification in separating columns 5, 8, and to produce refrigeration, a nitrogen refrigeration cycle is provided. The nitrogen from the head of the second separating column 8 is conducted, in part (conduit 9), through the heat exchanger 2 wherein it is heated while cooling the synthesis waste gas, and fed to the intake side of the first stage of a three-stage compressor 10. The pressure at the compressor inlet is about 1.5 bar. Another portion of the nitrogen (conduit 11) is heated in heat exchangers 12, 13 in heat exchange with two partial nitrogen streams of the nitrogen cycle, to be described below, and subsequently is likewise introduced into the first compressor stage.

A portion of the sump liquid from the second separating column 8 is withdrawn via a conduit 21, vaporized in heat exchanger 12, and returned into the second separating column 8.

To utilize each compressor stage optimally, the nitrogen is compressed in each stage approximately by a factor of 3, i.e. to 4.5; 13.5; and finally to 40.5 bar. The nitrogen compressed to the final pressure (conduit 15) is cooled in heat exchanger 13 in heat exchange with the nitrogen stream 11 as well as with a further low-pressure nitrogen stream 19 to be described below. Additional refrigeration is supplied by a refrigerant 14.

A portion of the final-pressure nitrogen is cooled in a reboiler 16 in the sump of the first separating column 5. The nitrogen, which is in the supercritical condition, is conducted during this step along the steep portion of the enthalpy curve (quasi condensation). Subsequently, the nitrogen passes into the heat exchanger 12 wherein it is subcooled and is finally expanded into a nitrogen storage tank 17 at a pressure of about 4.8 bar, the latter storage tank 17 also functioning as a phase separator permitting the withdrawal of gaseous nitrogen via conduit 22.

The residual portion of the final-pressure nitrogen is branched off from heat exchanger 13 before completing heat exchange and is engine-expanded in an expansion engine 18; during this step, the pressure of this residual nitrogen portion drops from about 40 bar to about 5 bar, and its temperature is reduced from about 132 K. to about 84 K. If necessary, part of the final-pressure nitrogen is branched off via conduit 26 and utilized further, for example, as a barrier gas for the compressor 10 or for synthesis gas.

The nitrogen 19 expanded in the expansion engine 18 is conducted through a section of the heat exchanger 12, wherein it absorbs heat, is further heated in heat exchanger 13, and fed to the compressor 10 at an intermediate point, namely on the intake side of the second compressor stage.

According to the invention, a nitrogen stream is withdrawn from the compressor 10 at an intermediate point, this nitrogen stream being at a medium pressure lying below the final pressure. This medium-pressure nitrogen stream is withdrawn via conduit 20 under a pressure of 13.5 bar from the outlet of the second compressor stage and cooled in heat exchanger 13 in parallel with the final-pressure nitrogen stream 15; further cooled in reboiler 16; liquefied and subcooled in heat exchanger 12; and finally likewise expanded into the nitrogen storage tank 17.

Thus, according to this invention, the nitrogen streams 15 and 20, which are at different pressure levels, cover the heat requirement of the two separating columns 5, 8. The predominant portion of the heat (about 90%) in the first separating column 5 is delivered by the final-pressure nitrogen 15, whereas the larger proportion of the heat in the second separating column 8 (about 75%) is supplied by the medium-pressure nitrogen 20.

Gaseous nitrogen 22 is withdrawn from the storage tank 17 and admixed to the engine-expanded nitrogen 19 upstream of the heat exchanger 12. The liquid nitrogen 23 from the storage tank 17 is, in part, vaporized in a heat exchanger 27, for example in heat exchange with argon product (not shown), and combined with the gaseous nitrogen 9 upstream of heat exchanger 2. The other part of the liquid nitrogen is introduced, on the one hand, as scrubbing liquid to the second separating column 8 (conduit 24) and, on the other hand, is conducted through a condenser 25 in the head of the first separating column 5 wherein it is vaporized, and is subsequently likewise combined in vapor form with the nitrogen stream 9.

Figure 2:
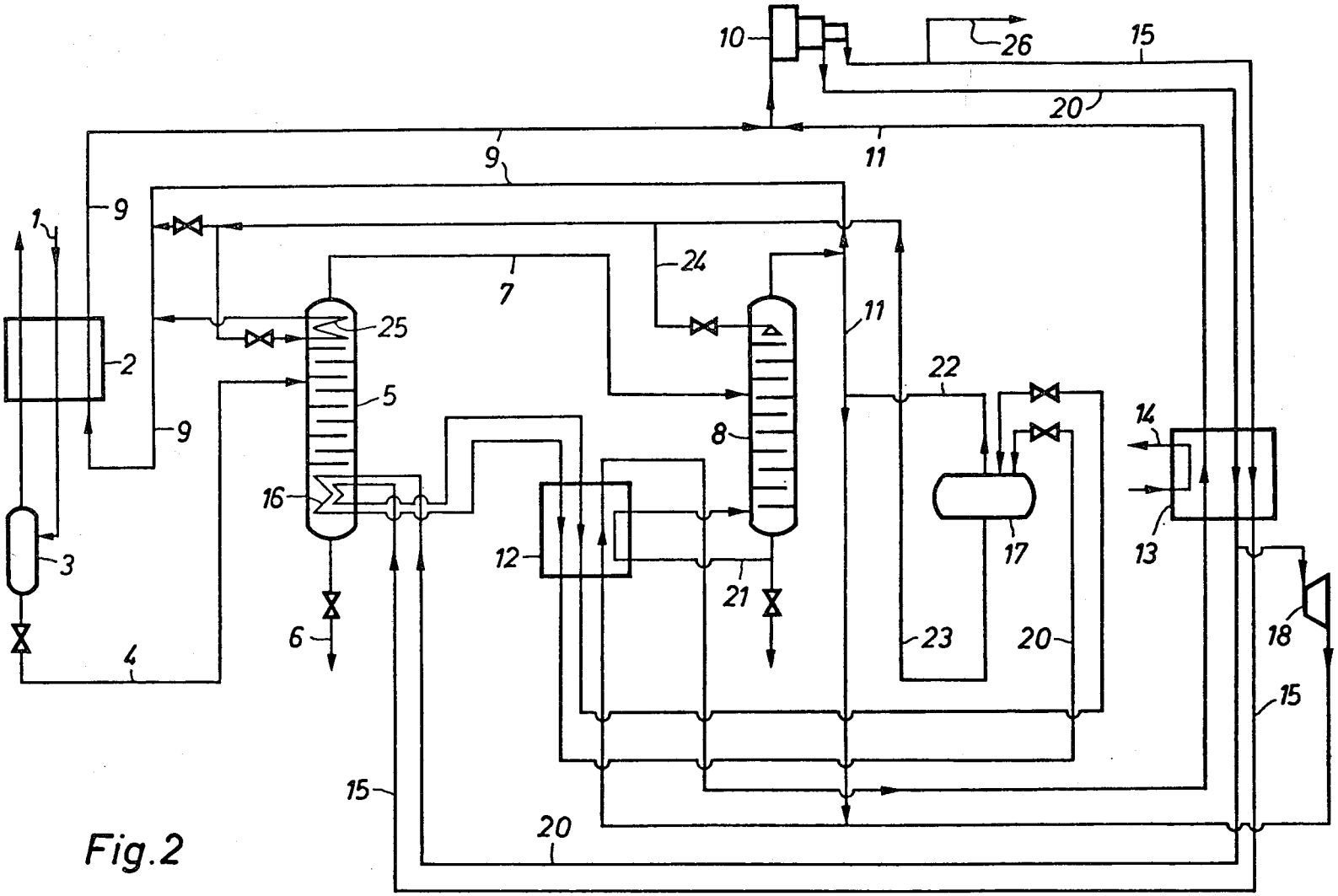
FIG. 2 is a modified preferred comprehensive embodiment of the invention, wherein engine-expanded gas is returned to the inlet of the first stage of a threestage compressor.

In FIG. 2, showing a modified embodiment of the process of this invention according to FIG. 1, identical reference numerals are employed for analogous parts of the installation. In this description, only the non-common features as compared with the process of FIG. 1 will be described. In the process according to FIG. 2, it is not the nitrogen at final pressure which is engine-expanded, but rather the nitrogen 20 at medium pressure, which is engine-expanded after passing the heat exchanger 13. In order to attain an optimum degree of efficiency at the expansion engine 18, the nitrogen of about 13 bar is expanded to 2 bar, thus being cooled from about 132 K. to about 84 K. The exhaust stream 19 from the expansion engine 18 is combined with the nitrogen 22 from the storage tank 17 and the combined streams are returned to compressor 10 after being heated in heat exchangers 12 and 13. However, in contrast to the process according to FIG. 1, the nitrogen is in this case introduced as early as at the intake side of the first compressor stage. Also, as contrasted to FIG. 1, a pressure of about 2 bar is ambient in storage tank 17.

Whereas the drawings are illustrated with a synthesis waste gas of a particular composition, it is to be understood that this invention can be used for the fractionation of any gas containing nitrogen, hydrogen, argon and methane, but it is particularly applicable to gases of the following compositional ranges:

| | mol-% |
|---|---|
| $N_2$ | 10–25 |
| $H_2$ | 30–70 |
| Ar | 2–20 |
| $CH_4$ | 5–40 |

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

We claim:

1. In a low temperature process for the fractionation of ammonia synthesis waste gas comprising two successive separating stages and a nitrogen refrigeration cycle for supplying reboiler heat to each of the stages and also liquid nitrogen, wherein nitrogen is compressed in a compressor to a final pressure, cooled, expanded, and partially liquefied, gaseous and revaporized liquid nitrogen being recompressed, the improvement comprising compressing the nitrogen (20) to a medium pressure below said final pressure, withdrawing a portion of resultant medium-pressure nitrogen from the compressor, compressing remaining medium-pressure nitrogen to the final pressure, said final pressure being not greater than 75 bar, cooling resultant medium-pressure nitrogen in parallel with resultant final-pressure nitrogen, further cooling the medium-pressure nitrogen by heating the two separating stages (5, 8), expanding resultant cooled medium-pressure nitrogen to at least partially liquefy the same, expanding resultant cooled final-pressure nitrogen (15) to at least partially liquefy the same, and combining both resultant at least partially liquefied nitrogen streams in a phase separator (17).

2. A process according to claim 1, wherein the medium pressure is between 6 and 20 bar.

3. A process according to claim 2, wherein the final pressure is between 30 and 50 bar.

4. A process according to claim 1, wherein the final pressure is between 30 and 50 bar.

5. A process according to claim 1, wherein a portion of compressed, cooled nitrogen is subjected to engine expansion; withdrawing a gaseous proportion of nitrogen from said phase separator and then combining said gaseous proportion (22) of the partially liquefied nitrogen with said engine-expanded portion.

6. A process according to claim 5, wherein the engine-expanded nitrogen is expanded to a pressure above the inlet pressure of the compressor (10) and is fed to the compressor (10) at an intermediate portion.

7. A process according to claim 5, wherein said engine expanded portion is 60–90% of the final-pressure nitrogen from the compressor.

8. A process according to claim 5, wherein said engine expanded portion is 70–90% of the medium-pressure nitrogen from the compressor.

9. A process according to claim 5, further comprising passing the engine expanded portion of nitrogen through a heat exchanger for heating thereof before being passed to the compressor.

10. A process according to claim 9, wherein the engine expanded portion combined with the gaseous proportion (22) is passed through the heat exchanger.

11. A process according to claim 1, further comprising withdrawing a portion of the liquefied nitrogen (23) from phase separator; vaporizing a portion of said withdrawn liquefied nitrogen at least partly by cooling the head of the first separating stage (5), withdrawing gaseous nitrogen from the head of the second separating stage (8); combining the vaporized nitrogen and the gaseous nitrogen, and heating the combined streams in heat exchange with synthesis waste gas (1), and subsequently conducting resultant heated combined streams to the inlet of compressor.

12. A process according to claim 11 wherein the quantity of said combined streams is essentially the same as the quantity of the nitrogen and argon components in the synthesis waste gas during the heat exchange.

13. A process according to claim 1, wherein the medium-pressure nitrogen (20) utilized for heating the first separating stage (5), yields between 5% and 20% of the required total heat in the first separating stage.

14. A process according to claim 13, wherein the medium-pressure nitrogen (20), utilized for heating the second separating stage (8), yields between 60% and 90% of the required total heat in the second separating stage (8).

15. A process according to claim 14, wherein the medium pressure is 6–20 bar and the final pressure is 30–50 bar.

16. A process according to claim 1, wherein the medium-pressure nitrogen (20), utilized for heating the second separating stage (8), yields between 60% and 90% of the required total heat in the second separating stage (8).

17. A process according to claim 1, wherein said cooling of said resultant medium-pressure nitrogen in parallel with resultant final-pressure nitrogen is effected in plate-type heat exchangers.

18. An Apparatus comprising elements designed, sized and arranged for fractionating ammonia synthesis gas with a nitrogen refrigeration cycle, including two series-connected separating columns; a nitrogen refrigeration cycle comprising a compressor means sized to effect compression to a pressure no greater than 75 bar, a heat exchanger (13), reboilers in the sump of the two separating columns, and a nitrogen storage tank (17); wherein the outlet of the said compressor means is in communication with the said heat exchanger, and the cold end of the latter is in communication with said two reboilers, and wherein the said reboilers terminate on the outlet side into said storage tank, said compressor means (10) having at least two stages, wherein the outlets of said two compressor stages are conducted separately from each other through said heat exchanger (13) and said two reboilers, and terminate together into said storage tank (17); and that the flow path for the nitrogen from said first or second compressor stage is in communication with an expansion engine (18).

19. Apparatus according to claim 18, wherein the expansion engine (18) is connected to the outlet side via a heat exchanger (12) with a return conduit (11, 19) for gaseous nitrogen leading to the compressor (10).

20. Apparatus according to claim 18, further comprising condenser means (25) in the head of the first separating column (5) connected on the inlet side with the nitrogen storage tank (17) and on the outlet side with a further return conduit (9) for gaseous nitrogen leading to the compressor (10).

* * * * *